US008270885B2

(12) United States Patent
Yoshida

(10) Patent No.: US 8,270,885 B2
(45) Date of Patent: Sep. 18, 2012

(54) IMAGE FORMING APPARATUS UTILIZING PLURAL PRESSERS OF DIFFERENT WEIGHTS AND IMAGE FORMING METHOD FORMING AN IMAGE WITH THE IMAGE FORMING APPARATUS

(75) Inventor: Ken Yoshida, Chigasaki (JP)

(73) Assignee: Ricoh Company, Limited, Tokyo (JP)

( * ) Notice: Subject to any disclaimer, the term of this patent is extended or adjusted under 35 U.S.C. 154(b) by 282 days.

(21) Appl. No.: 12/163,335

(22) Filed: Jun. 27, 2008

(65) Prior Publication Data

US 2009/0016784 A1 Jan. 15, 2009

(30) Foreign Application Priority Data

Jul. 10, 2007 (JP) ..... 2007-181466
Feb. 6, 2008 (JP) ..... 2008-026587

(51) Int. Cl.
*G03G 15/08* (2006.01)

(52) U.S. Cl. ..... 399/299

(58) Field of Classification Search ..... 399/299, 399/306, 302, 308
See application file for complete search history.

(56) References Cited

U.S. PATENT DOCUMENTS

| | | | | |
|---|---|---|---|---|
| 5,778,291 | A | 7/1998 | Okubo et al. | |
| 6,519,438 | B2 * | 2/2003 | Munemori et al. | 399/298 |
| 6,556,802 | B2 * | 4/2003 | Sasamoto et al. | 399/299 |
| 6,681,094 | B2 * | 1/2004 | Horrall et al. | 399/299 |
| 7,003,238 | B2 | 2/2006 | Yoshida et al. | |
| 7,162,179 | B2 | 1/2007 | Yoshida | |
| 7,280,792 | B2 | 10/2007 | Sawai et al. | |
| 2004/0179860 | A1 | 9/2004 | Watanabe et al. | |
| 2005/0191096 | A1 * | 9/2005 | Lee | 399/313 |
| 2007/0127960 | A1 | 6/2007 | Yoshida et al. | |
| 2007/0269241 | A1 | 11/2007 | Sawai et al. | |
| 2007/0280748 | A1 | 12/2007 | Yoshida | |
| 2009/0016784 | A1 | 1/2009 | Yoshida | |

FOREIGN PATENT DOCUMENTS

| | | |
|---|---|---|
| EP | 1 857 888 A1 | 11/2007 |
| EP | 1 862 867 A1 | 12/2007 |
| JP | 2-24686 | 1/1990 |
| JP | 3-100661 | 4/1991 |

(Continued)

OTHER PUBLICATIONS

Translation of JP2005-024936A; Jan. 27, 2005.*

(Continued)

*Primary Examiner* — Quana M Grainger
(74) *Attorney, Agent, or Firm* — Oblon, Spivak, McClelland, Maier & Neustadt, L.L.P.

(57) ABSTRACT

An image forming apparatus, including:

plural image bearers bearing toner images including a black toner image, which are developed with a two-component developer including a carrier and a toner comprising a binder resin and an additive; a receptor receiving the toner images; plural pressers each pressing the receptor to each of the plural image bearers at a predetermined pressure, wherein the additive has a burial rate X indicated by the following formula not less than 40%:

$$X=(A-B)/A\times 100$$

wherein A represents a BET specific surface area ($cm^2/g$) of the toner; and B represents a BET specific surface area ($cm^2/g$) of the toner after buried, and wherein one of the pressers pressing the receptor to the image bearer bearing the black toner image presses the receptor thereto at a pressure lower than those of the other pressers.

20 Claims, 5 Drawing Sheets

FOREIGN PATENT DOCUMENTS

| | | | | |
|---|---|---|---|---|
| JP | 3-180880 | | | 8/1991 |
| JP | 5-323671 | | | 12/1993 |
| JP | 07064403 | A | * | 3/1995 |
| JP | 7-152202 | | | 6/1995 |
| JP | 09120217 | A | * | 5/1997 |
| JP | 9-152791 | | | 6/1997 |
| JP | 9-319134 | | | 12/1997 |
| JP | 11065213 | A | * | 3/1999 |
| JP | 2978367 | | | 9/1999 |
| JP | 3056122 | | | 4/2000 |
| JP | 2000131921 | A | * | 5/2000 |
| JP | 2000-155476 | | | 6/2000 |
| JP | 2000-162899 | | | 6/2000 |
| JP | 3140186 | | | 12/2000 |
| JP | 2001-194932 | | | 7/2001 |
| JP | 2002-14515 | | | 1/2002 |
| JP | 3328013 | | | 7/2002 |
| JP | 2002-318494 | | | 10/2002 |
| JP | 2003-98770 | | | 4/2003 |
| JP | 2004-264559 | | | 9/2004 |
| JP | 2005-24936 | | | 1/2005 |
| JP | 2005-266614 | | | 9/2005 |
| JP | 3762078 | | | 1/2006 |
| JP | 2006-301673 | | | 11/2006 |
| JP | 2006337451 | A | * | 12/2006 |
| JP | 2006337454 | A | * | 12/2006 |
| JP | 2007-41202 | | | 2/2007 |
| JP | 2007-71963 | | | 3/2007 |
| JP | 2007-108622 | | | 4/2007 |
| JP | 2007-114304 | | | 5/2007 |
| JP | 2007-133022 | | | 5/2007 |
| JP | 2007-304404 | | | 11/2007 |
| JP | 2007-310024 | | | 11/2007 |
| JP | 2008107506 | A | * | 5/2008 |

OTHER PUBLICATIONS computer translation of JP2008-107506A, May 2008 to Mochizuki.*
Information Statement issued Mar. 5, 2011, in Japan Patent Application No. 2008-64799 (with English translation).

* cited by examiner

FIG. 3

| | | COMPARATIVE EXAMPLE1 | COMPARATIVE EXAMPLE2 | COMPARATIVE EXAMPLE3 | EXAMPLE1 | EXAMPLE2 |
|---|---|---|---|---|---|---|
| FIRST TRANSFER PRESSURE [g/cm$^2$] | Y | 100 | 70 | 50 | 100 | 100 |
| | M | 100 | 70 | 50 | 100 | 100 |
| | C | 100 | 70 | 50 | 100 | 100 |
| | K | 100 | 70 | 50 | 70 | 50 |
| GRAINY LEVEL | M | 3 | 4 | 5 | 4 | 4 |
| | C | 3 | 5 | 5 | 4 | 5 |
| | K | 4 | 5 | 5 | 5 | 5 |
| HOLLOW LEVEL | 1C | 4 | 5 | 4 | 5 | 4 |
| | 2C | 4 | 3 | 2 | 4 | 4 |

FIG. 4

| | | COMPAR-ATIVE EXAMPLE4 | COMPAR-ATIVE EXAMPLE5 | COMPAR-ATIVE EXAMPLE6 | COMPAR-ATIVE EXAMPLE7 | COMPAR-ATIVE EXAMPLE8 | COMPAR-ATIVE EXAMPLE9 | EXAMPLE3 | EXAMPLE4 | EXAMPLE5 |
|---|---|---|---|---|---|---|---|---|---|---|
| ADDITIVE BURIAL RATE [%] | | 30 | 38 | 38 | 42 | 56 | 70 | 42 | 56 | 70 |
| TONER RESIN | | STYRENE-ACRYLIC RESIN | STYRENE-ACRYLIC RESIN | POLY-ESTER RESIN | POLY-ESTER RESIN | POLY-ESTER RESIN | POLY-ESTER RESIN | POLY-ESTER RESIN | POLY-ESTER RESIN | POLY-ESTER RESIN |
| FIRST TRANS-FER PRESSURE [g/cm$^2$] | Y | 100 | 100 | 100 | 100 | 100 | 100 | 100 | 100 | 100 |
| | M | 100 | 100 | 100 | 100 | 100 | 100 | 100 | 100 | 100 |
| | C | 100 | 100 | 100 | 100 | 100 | 100 | 100 | 100 | 100 |
| | K | 100 | 100 | 100 | 100 | 100 | 100 | 50 | 50 | 50 |
| GRAINY LEVEL | M | 4 | 3 | 3 | 3 | 2 | 2 | 4 | 4 | 4 |
| | C | 4 | 4 | 4 | 3 | 3 | 3 | 5 | 4 | 4 |
| | K | 5 | 4 | 4 | 4 | 4 | 3 | 5 | 5 | 4 |
| HOLLOW LEVEL | 1C | 4 | 4 | 4 | 4 | 4 | 4 | 4 | 4 | 4 |
| | 2C | 4 | 4 | 4 | 4 | 4 | 4 | 4 | 4 | 4 |
| FIXABILITY (10°C, 15%) | | × | × | × | ○ | ○ | ○ | ○ | ○ | ○ |

| | COLOR ORDER | HOLLOW LEVEL | | |
|---|---|---|---|---|
| | | RED | GREEN | BLUE |
| EXAMPLE6 | YMCK | ○ | ○ | ○ |
| COMPARATIVE EXAMPLE10 | YCMK | ○ | ○ | × |
| COMPARATIVE EXAMPLE11 | MCYK | × | × | ○ |
| COMPARATIVE EXAMPLE12 | CMYK | × | × | × |

IMAGE FORMING APPARATUS UTILIZING PLURAL PRESSERS OF DIFFERENT WEIGHTS AND IMAGE FORMING METHOD FORMING AN IMAGE WITH THE IMAGE FORMING APPARATUS

BACKGROUND OF THE INVENTION

1. Field of the Invention

The present invention relates to an image forming apparatus such as a copier, a facsimile and a printer, and more particularly to an image forming apparatus having plural image bearers and using a two-component developer including a toner and a carrier, and an image forming method using the image forming apparatus.

2. Discussion of the Background

Image forming apparatuses such as copiers, facsimiles and printers equipped with plural image bearers such as photoreceptors for the purpose of forming color images are known. Such image forming apparatuses use a direct transfer method of directly multi-transferring toner images formed by the plural image bearers onto a sheet such as a paper and fixing the toner images thereon upon application of heat, etc.; and an intermediate transfer method of multi-transferring toner images onto an intermediate transferer, transferring them onto a sheet and fixing them thereon. The intermediate transfer method is, in other words, an indirect transfer method.

For example, a full-color image forming apparatus using an intermediate transfer method is equipped with a first transferer transferring a toner image on an image bearer onto an intermediate transferee, a second transferer transferring the toner image on the intermediate transferer onto a sheet, a first cleaner cleaning a toner remaining on the image bearer after the toner image is transferred onto the intermediate transferee, and a second cleaner cleaning a toner remaining on the intermediate transferer after the toner image is transferred onto the sheet. These cleaners are typically equipped with a cleaning blade scraping the toner remaining on the image bearer and the intermediate transferer.

A two-component developer including a toner and a carrier is well known as a developer forming images. In an image forming apparatus using the two-component developer, a toner in the developer is borne by the image bearer to form a toner image, the toner image is transferred onto a sheet such as a paper, and the toner image fixed thereon upon receipt of a heat energy, etc.

A toner used for developing an electrostatic latent image is typically a colored particle formed of a binder resin including a colorant, a charge controlling agent and other additives, and is broadly classified into a pulverized toner and a chemical toner.

A toner having a smaller particle diameter produces images having higher definition and quality. The pulverized toner prepared by conventional kneading and pulverizing methods having an amorphous shape produces images having poor granularity and sharpness. In addition, having poor fluidity as a powder due to the shape, the pulverized toner needs a large amount of a fluidizer and has a low filling rate in a toner bottle, which prevents the apparatus from being downsized. Further, the pulverized toner has a minimum particle size larger than that of the chemical toner.

Further, in a full-color image forming apparatus having a complicated transfer process, i.e., a toner image is transferred from an image bearer to an intermediate transferer and to a sheet therefrom, the pulverized toner having poor transferability due to the amorphous shape causes images having blank spots and a large consumption thereof to cover the poor transferability.

In order to solve the problems of the amorphous toner, various methods of preparing spheric chemical toners are developed.

The method of preparing chemical toners include suspension polymerization methods and emulsion polymerization condensation methods. Japanese published unexamined application No. 7-152202 discloses a polymer solution suspension method. This is a method of dispersing or dissolving toner materials in a volatile solvent such as an organic solvent having a low boiling point to prepare a dispersion or a solution, emulsifying and dripping the dispersion or solution in an aqueous medium with the presence of a dispersant, and removing the volatile solvent.

Japanese published unexamined application No. 11-149179 discloses a method of using a low-molecular-weight resin in the polymer solution suspension method to decrease the viscosity of the dispersion. Therefore, the dispersibility and emulsification of the toner materials improve, and further the fixability of the resultant toner improves because the toner materials were subjected to a polymerization reaction in a particle.

Differently from the suspension polymerization methods and emulsion polymerization condensation methods, these methods can use general-purpose resins. Particularly, a polyester resin having good low-temperature fixability and effectively used for full-color processes needing transparency and image smoothness after fixed can be used. These methods are particularly called ester elongation polymerization methods.

However, a spherical toner having a small particle diameter has very poor cleanability. In addition, having good transferability, the spherical toners having smaller particle diameters adhere more to a photoreceptor, resulting in deterioration of the transferability.

Japanese published unexamined application No. 3-100661 discloses adding a medium-size inorganic particulate material having an average particle diameter of from 20 to 40 nm to an external additive in order to improve cleanability and transferability. Japanese Patents Nos. 3328013 and 3056122, and Japanese published unexamined application No. 9-319134 disclose using a large-size inorganic particulate material having an average particle diameter not less than 100 nm as an external additive to assure cleanability and to prevent other small-size additives from being buried by a stress in an image developer.

However, these initially have good cleanability and transferability, but the external additives are buried as time passes.

Recent demands for saving resources and electrical power require reduction of energy for fixing a toner, and therefore a toner being a resin powder is having a lower softening point. A toner having a lower softening point preferably includes comparatively a soft resin such as a polyester resin as a binder resin forming the toner.

It is difficult to maintain good cleanability and transferability even by the arts disclosed in Japanese published unexamined applications Nos. 3-100661 and 9-319134, and in Japanese Patents Nos. 3328013 and 3056122, because the polyester resins has a mechanical strength lower than those of other resins. Therefore, an image forming apparatus producing high-resolution and high-quality images for long periods even with a toner including a polyester resin having good low-temperature fixability and in which an external additive is likely to be buried.

Meanwhile, a toner image is required to faithfully and stably transferred from an image bearer onto an intermediate transferee, and from the intermediate transferer onto a sheet.

Therefore, a full-color image forming apparatus using the intermediate transferer occasionally has a pressurizer pressing the intermediate transferer to the image bearer. The pressurizer pressurizes between the image bearer and the intermediate transferer to increase transfer efficiency and prevent defective transfers such as hollow images. The pressurizer also prevents the intermediate transferer from waving and evenly contacts the intermediate transferer to the surface of the image bearer to prevent uneven transferer.

However, when a pressure is applied between the image bearer and the intermediate transferer, a stress is concentrated on a part of a toner image thereon, resulting in occasional defective transfers, i.e., the centers of toner images, particularly line images and letter images on the intermediate transferer drop out.

In order to prevent such defective transfers, Japanese published unexamined applications Nos. 2003-098770, 2000-162899 and 2000-155476 disclose methods of fixing a contact pressure of a first transferer to an image bearer in a specific range so as not to apply a pressure more than predetermined to a toner image.

However, the most suitable pressure depends on an adherence amount of a toner, e.g., monochrome or multicolor-layered images. When the pressure is less or more than the most suitable pressure, the defective transfers cannot be sufficiently improved or even worsen.

In order to solve this problem, Japanese published unexamined applications Nos. 2002-014515 and 2005-024936 disclose methods of lowering the contact pressure to the downstream transfer site than that to the upstream transfer site, or differentiating the contact pressures to a black transfer site and the most upstream transfer site. Japanese published unexamined application No. 2006-301673 discloses a method of contacting a transfer unit including an intermediate transferer to an image bearer under its own weight to stably contact the transfer unit thereto.

However, controlling the pressure of a first transferer to an image bearer influences not only upon defective transfers but also on performance of a second transfer. When a sheet is a paper having low smoothness, the transferability of a toner differs due to concavities and convexities on the surface of the paper, resulting in scabrous or grainy images. Particularly, in an image forming apparatus using a two-component developer including a soft toner, the pressure of the first transferer needs considerate adjustment in consideration of the influence upon the second transfer.

Because of these reasons, a need exists for an image forming apparatus smoothly transferring toner images even from plural image bearers, using a two-component developer including comparatively a soft toner and a carrier.

SUMMARY OF THE INVENTION

Accordingly, an object of the present invention is to provide an image forming apparatus such as copiers, facsimiles and printers smoothly transferring toner images even from plural image bearers, using a two-component developer including comparatively a soft toner and a carrier.

Another object of the present invention is to provide an image forming method using the image forming apparatus.

These objects and other objects of the present invention, either individually or collectively, have been satisfied by the discovery of an image forming apparatus, comprising:

plural image bearers configured bear toner images comprising a black toner image, which are developed with a two-component developer comprising a carrier and a toner comprising a binder resin and an additive;

a receptor configured to receive the toner images;

plural pressers each configured to press the receptor to each of the plural image bearers at a predetermined pressure, wherein the additive has a burial rate X indicated by the following formula not less than 40%:

$$X=(A-B)/A\times 100$$

wherein A represents a BET specific surface area ($cm^2/g$) of the toner; and B represents a BET specific surface area ($cm^2/g$) of the toner after buried, and wherein one of the pressers pressing the receptor to the image bearer bearing the black toner image presses the receptor thereto at a pressure lower than those of the other pressers.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein:

FIG. 3 is a Table showing evaluation results of grainy and hollow images when first transfer pressures are varied;

FIG. 4 is a Table showing evaluation results of grainy and hollow images, and fixability at a low temperature and a low humidity when first transfer pressures and burial rates of additives of toners are varied;

DETAILED DESCRIPTION OF THE INVENTION

Figure 1:
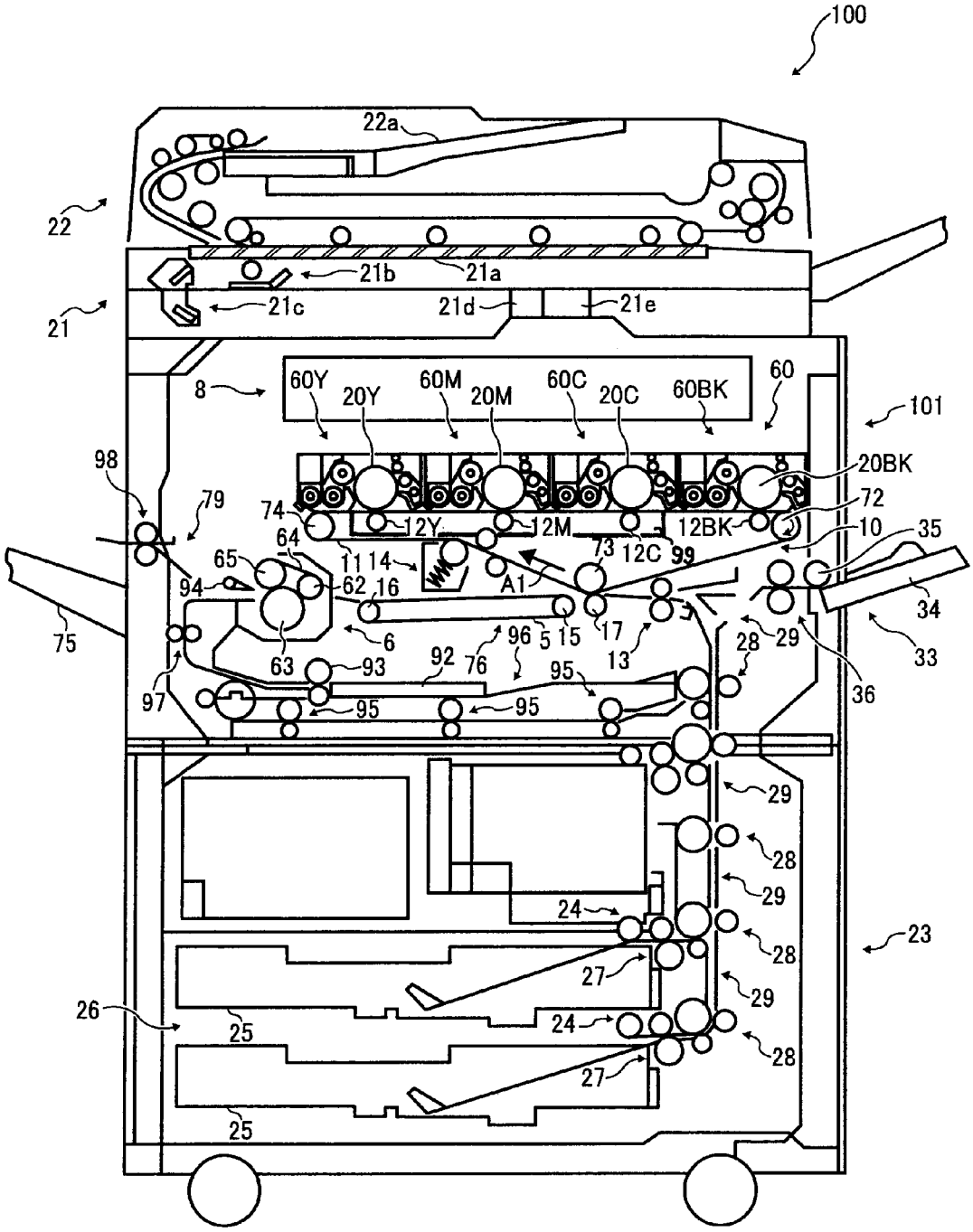
FIG. 1 is a schematic elevational view illustrating an embodiment of the image forming apparatus of the present invention.

The present invention provides an image forming apparatus such as copiers, facsimiles and printers smoothly transferring toner images even from plural image bearers, using a two-component developer including comparatively a soft toner and a carrier.

Particularly, the present invention relates to an image forming apparatus, comprising:

plural image bearers configured bear toner images comprising a black toner image, which are developed with a two-component developer comprising a carrier and a toner comprising a binder resin and an additive;

a receptor configured to receive the toner images;

plural pressers each configured to press the receptor to each of the plural image bearers at a predetermined pressure, wherein the additive has a burial rate X indicated by the following formula not less than 40%:

$X=(A-B)/A\times100$ wherein A represents a BET specific surface area ($cm^2/g$) of the toner; and B represents a BET specific surface area ($cm^2/g$) of the toner after buried, and wherein one of the pressers pressing the receptor to the image bearer bearing the black toner image presses the receptor thereto at a pressure lower than those of the other pressers.

The image forming apparatus is capable of smoothly transferring toner images using a two-component developer including comparatively a soft toner and a carrier, producing quality images, and maintaining fixability even when lowering a fixable temperature to save energy.

The presser has a pressing member contacting the receptor to vertically press the receptor to the image bearer. The pressing member does not have to press the receptor to the image bearer against gravitational force and can uniformly press the receptor thereto to prevent defective transfers, and can lower the pressure.

When the pressing member has an ASKER C hardness of 50 or less, the pressing member is squashy and an area contacting the receptor becomes large and can uniformly press the receptor to the image bearer to prevent defective transfers, and can lower the pressure.

The receptor is an intermediate transferer, and the image forming apparatus has a first transferer well transferring a toner image from the image bearer onto the intermediate transferer and a second transferer well transferring the toner image thereon onto a sheet.

When a black toner image is transferred onto the intermediate transferer from the image bearer last, the first and second transfers can be performed well, and quality images can be produced because a black image is distinct and is seldom overlapped with other colors.

When a yellow toner image is transferred onto the intermediate transferer from the image bearer first, the first and second transfers can be performed well, and quality images can be produced because a yellow image is indistinctive.

When a magenta toner image and a cyan toner image are transferred onto the intermediate transferer from the image bearers secondly and thirdly in this order, the first and second transfers can be performed well, and quality images can be produced because they are indistinctive in this order.

When the binder resin is a polyester resin, the image forming apparatus is capable of smoothly transferring toner images using a two-component developer including comparatively a soft toner including the polyester resin and a carrier, producing quality images, and maintaining fixability even when lowering a fixable temperature to save energy.

FIG. 1 is a schematic elevational view illustrating an embodiment of the image forming apparatus of the present invention. An image forming apparatus 100 is a complex machine including a copier, a printer and a facsimile, capable of producing fill-color images. When the image forming apparatus 100 is used as a printer, it produces images based on image signals corresponding to image information it receives from outside. This is same when the image forming apparatus 100 is used as a facsimile.

The image forming apparatus 100 is capable of forming images on any sheet-shaped recoding media such as OHP sheets, cards, postcards and envelopes besides plain papers for copy use. The image forming apparatus 100 is also capable of forming images on both sides of the sheet-shaped recoding media.

The image forming apparatus 100 includes a main body 101, a reader 21 located above the main body 101 as a scanner reading originals, an automatic document feeder (ADF) 22 loading the originals and feeding them to the reader 21 and a sheet feeder 23 located below the main body 101 as a paper feed table loading sheets fed between photoreceptor drums 20Y, 20M, 20C and 20BK, and an intermediate transfer belt 11.

The image forming apparatus 100 is a tandem-type image forming apparatus including the photoreceptor drums 20Y, 20M, 20C and 20BK as plural image bearers capable of separately forming a yellow image, a magenta image, a cyan image and a black image. The photoreceptor drums 20Y, 20M, 20C and 20BK have a same diameter and are placed at even intervals on an outer circumferential side, i.e., an image forming side of the endless intermediate transfer belt 11 located at almost the inner center of the main body 101 as an intermediate transferer (a receptor).

The intermediate transfer belt 11 is rotatable in the direction indicated by an arrow A1, facing the photoreceptor drums 20Y, 20M, 20C and 20BK. A visible image, i.e., a toner image formed on each of the photoreceptor drums 20Y, 20M, 20C and 20BK is respectively transferred onto the intermediate transfer belt 11 rotating in the direction indicated by an arrow A1 to be overlapped thereon, and then the overlapped images are transferred onto a sheet at a time. The image forming apparatus 100 uses an intermediate transfer method, in other words, an indirect transfer method.

First transfer rollers 12Y, 12M, 12C and 12BK as first transfer chargers located facing the photoreceptor drums 20Y, 20M, 20C and 20BK across the intermediate transfer belt 11 apply voltages thereto with timing adjustment of the voltage application from upstream to downstream of the direction A1 such that toner images formed on the photoreceptor drums 20Y, 20M, 20C and 20BK are transferred onto a same position of the intermediate transfer belt 11 to be overlapped thereon while rotating in the direction A1.

Methods and materials for preparing the intermediate transfer belt 11 are not particularly limited, however, a polyimide resin is preferably used in terms of strength.

The intermediate transfer belt 11 formed of a polyimide resin is preferably prepared by the following method.

Carbon black is dispersed in a polyamic acid solution to prepare a dispersion, the dispersion is poured into a metallic drum and dried, s peeled film centrifugally formed from the metallic drum rotating is elongated under high temperature of from 100 to 200° C. to form a polyimide film, and the film is properly cut to form an endless belt formed of a polyimide resin.

An iron core is covered with the half-hardened film and the film is further hardened at 300 to 450° C. to prepare the intermediate transfer belt 11.

The properties of the intermediate transfer belt 11 can be controlled with the carbon quantity, calcination temperature, hardening speed, etc. These can also control the volume resistivity and surface resistivity.

The volume resistivity and surface resistivity mentioned later are measured by a resistance meter HIRESTER UP MCP-HT450 from Mitsubishi Chemical Corp., using a probe MCP-HTP14 therefore.

The photoreceptor drums 20Y, 20M, 20C and 20BK are located in this order in line from the upstream of the direction A1. They are installed in image forming stations 60Y, 60M, 60C and 60BK for forming yellow, magenta, cyan and black images, respectively.

The image forming apparatus 100 has an image forming unit 60 including the four image forming stations 60Y, 60M, 60C and 60BK; a transfer belt unit 10 as an intermediate transfer unit including the intermediate transfer belt 11 below the photoreceptor drums 20Y, 20M, 20C and 20BK, facing them; a second transfer roller 17 as a second transferer contacting the intermediate transfer belt 11 and rotating in the same direction thereof at the contact point to transfer a toner image thereon onto a sheet; a sheet transporter 76 transporting the sheet, onto which the toner image on the intermediate transfer belt 11 is transferred by the second transfer roller 17; and an intermediate transfer belt cleaner 14 located facing the intermediate transfer belt 11 to clean the intermediate transfer belt 11 after the toner image is transferred onto the sheet.

The image forming apparatus 100 also has an optical scanner 8 located above the image forming stations 60Y, 60M, 60C and 60BK, facing them as an irradiator writing with light; a pair of register rollers 13 placing a sheet fed from the sheet feeder 23 between the intermediate transfer belt 11 and the second transfer roller 17 at a predetermined timing of forming toner images in the image forming stations 60Y, 60M, 60C and 60BK; and a sensor (not shown) detecting an end of the sheet at the pair of register rollers 13.

Further, the image forming apparatus 100 has a fixer 6 as a belt fixing unit fixing the toner image on the sheet transported therein by the sheet transporter 76; a paper discharging unit 79 including a paper discharging path discharging the sheet out of the main body 101 and a reverse path transporting the sheet to the pair of register rollers 13 again to transport the sheet to either path; and a both side printing unit 96 switching back the sheet to reverse when the paper discharging unit 79 transports the sheet having an image on one side to the reverse path.

Furthermore, the image forming apparatus 100 has a discharged paper tray 75 located out of the main body 101, loading the sheet images are formed on; a manual paper feeder 33 located on the right side of the main body 101 in FIG. 1; an operation panel (not shown) operating the image forming apparatus 100; and a controller (not shown) controlling all performances thereof.

Besides the intermediate transfer belt 11, the transfer belt unit 10 has first transfer rollers 12Y, 12M, 12C and 12BK; a drive roller 72 hanging the intermediate transfer belt 11; a transfer entrance roller 73; a tension roller 74; and a drive unit 99.

The transfer belt unit 10 rotates the drive roller 72 anticlockwise in FIG. 1 with the drive unit 99 to set the photoreceptor drums 20Y, 20M and 20C apart from the intermediate transfer belt 11, keeping the photoreceptor drum 20BK contacting thereto.

When a monochrome black image is formed, the photoreceptor drums 20Y, 20M and 20C are set apart from the intermediate transfer belt 11. The controller activates the drive unit 99.

Since the image forming apparatus 100 has the intermediate transfer belt cleaner 14, the photoreceptor drums 20Y, 20M and 20C need not be set apart from the intermediate transfer belt 11 because a black toner remaining thereon does not contaminate them. However, the photoreceptor drums 20Y, 20M and 20C are set apart from the intermediate transfer belt 11 when a monochrome black image is formed in case even the intermediate transfer belt cleaner 14 does not completely remove the remaining toner for some reason. The black toner is so visible that the resultant images deteriorate when adhering to the photoreceptor drums 20Y, 20M and 20C.

The photoreceptor drum 20BK forming a black image is located downstream side of the photoreceptor drums 20Y, 20M and 20C in the direction A1. This is because it is most preferable that the photoreceptor drum 20BK is located at the most downstream position in the direction A1 and transfer a black toner image last onto the intermediate transfer belt 11 to prevent a black toner from adhering to the photoreceptor drums 20Y, 20M and 20C therethrough when the photoreceptor drums 20Y, 20M, 20C and 20BK contact the intermediate transfer belt 11 to form a full-color image.

The pair of register rollers 13 are earthed. This is because a paper powder is generally difficult to move to the photoreceptor drums 20Y, 20M, 20C and 20BK in the image forming apparatus 100 using the intermediate transfer method and a paper powder transfer need not be considered.

However, a bias may be applied to the pair of register rollers 13 to remove the paper powder. When the pair of register rollers are formed of rollers having a diameter of 18 mm, coated with an electroconductive NBR rubber having a thickness of 1 mm and a volume resistivity about $10^9$ ΩQ·cm, a voltage about −800 V is applied to the roller contacting the surface side of a sheet a toner is transferred onto and a voltage about +200 V is applied to the roller contacting the backside of the sheet.

A DC bias is typically applied thereto, and an AC voltage including a DC offset element can be applied thereto to more uniformly charge a sheet.

The sheet surface is negatively charged slightly after passing the pair of register rollers 13, and therefore the transfer conditions are occasionally changed from those when the pair of register rollers 13 are not applied with a voltage.

The sheet transporter 76 has an endless transport belt 5, and a derive roller 15 and a driven roller 16 hanging the transport belt 5.

The second transfer roller 17 facing the transfer entrance roller 73 contacts the intermediate transfer belt 11 with pressure between the transfer entrance roller 73 and the intermediate transfer belt 11.

Figures 5, 6:
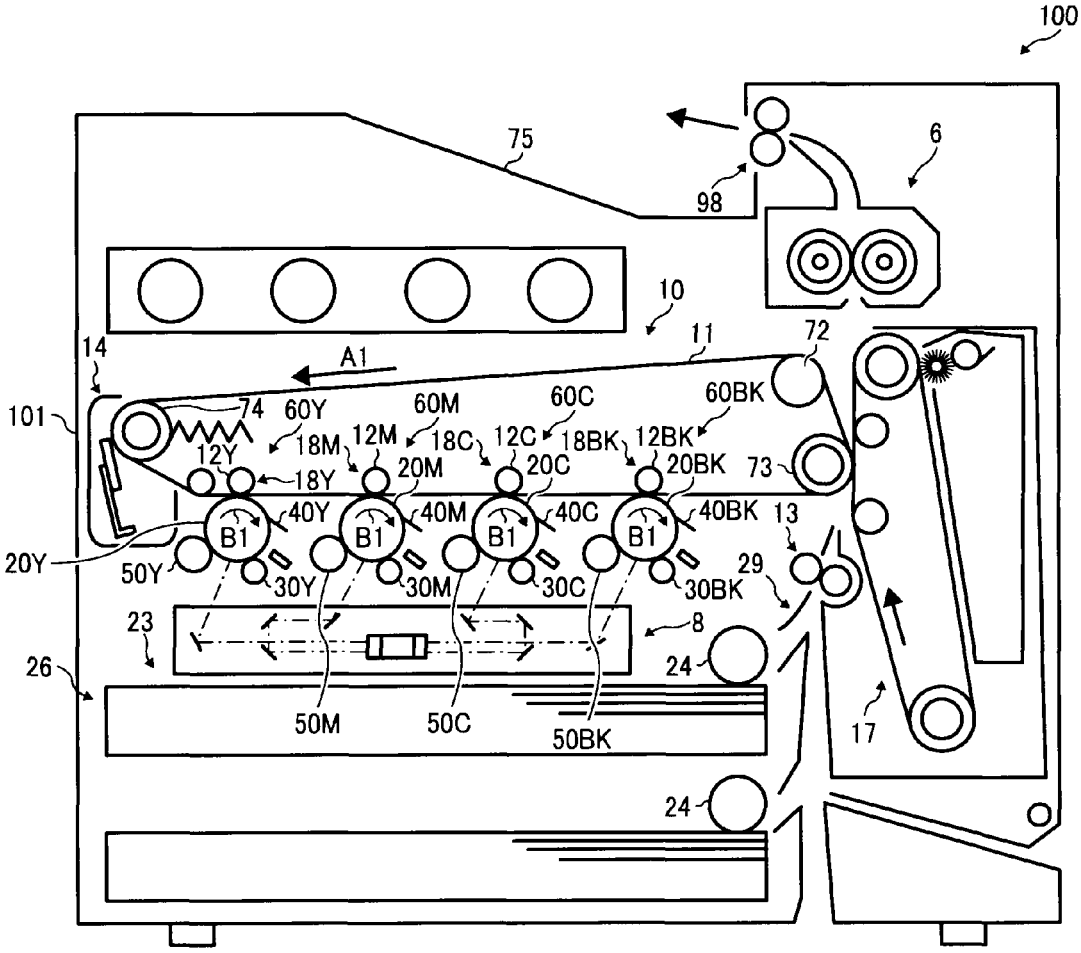
FIG. 5 is a Table showing evaluation results of grainy levels of two-color layered images when color orders are varied.
FIG. 6 is a schematic elevational view illustrating another embodiment of the image forming apparatus of the present invention.

The second transfer roller 17 may have a non-contact charger, or a transfer transport unit combined with the driven roller 16 of the sheet transporter 76 transporting the sheet to the fixer 6 shown as 17 in FIG. 6.

The optical scanner 8 has a light emitting source (not shown) irradiating the surfaces of the photoreceptor drums 20Y, 20M, 20C and 20BK with a laser beam (not shown) based on an image signal to form an electrostatic latent image thereon; a polygon mirror (not shown) rotating to reflect the laser beam; a polygon motor (not shown); and many optical elements forming an electrostatic latent image on the photoreceptor drums 20Y, 20M, 20C and 20BK. The laser beam is irradiated to the photoreceptor drums 20Y, 20M, 20C and 20BK in the vertical direction of the sheet in FIG. 1.

The fixer 6 has a heat roller 62 and a fixing roller 65 hanging a fixing belt 64, and a pressure roller 63 contacting the fixing belt 64 with pressure between the fixing roller 65 and the fixing belt 64. A sheet bearing a toner image passes through a contact point with pressure between the fixing belt 64 and the pressure roller 63 such that the toner image is fixed on the surface of the sheet with heat and pressure.

The paper discharging unit 79 has a transport roller 97 transporting the sheet a toner image is fixed on to the both side printing unit 96; a paper discharging roller 98 discharging the sheet out of the main body 101; and a switcher 94 leading the sheet a toner image is fixed on to the paper discharging path having the paper discharging roller 98 to discharge the sheet out of the main body 101 or the reverse path having the transport roller 97 to let the sheet into the both side printing unit 96.

The both side printing unit 96 has a tray 92 once loading the sheet transported from the paper discharging unit 79, on one side of which an image is formed; a reverse roller 93 switching back the sheet on the tray 92; and a paper feed roller 95 feeding the sheet switched back by the reverse roller 93 toward the register roller 13.

The sheet feeder 23 has a paper bank 26 having a paper feeding cassette 25 loading a number of sheets; a feed roller 24 contacting the upper surface of the sheet at the top the sheets loaded in the paper feeding cassette 25; a separation roller 27 separating the sheets one by one run out by the feed roller 24; a transport roller 28 transporting the sheet sent out from the feed roller 24 and the separation roller 27 toward the register roller 13; and a paper feeding path 29 the sheet transported by the transport roller 28 passes through. The paper feeding path 29 is so formed as to continue in the main body 101 from the sheet feeder 23, and a paper feeding path 29 in the main body 101 also has a transport roller 28.

The feed roller 24 is driven to rotate anticlockwise in FIG. 1 and the separation roller 27 operates to lead a sheet on the top into the paper feeding path 29, and the transport roller 28 rotates to transport the sheet toward the register roller 13 until the sheet stops thereat.

The manual paper feeder 33 has a manual tray 34 loading sheets; a feed roller 35 contacting the upper surface of a sheet on the top of the sheets loaded on the manual tray 34; a separation roller 36 separating the sheets one by one run out by the feed roller 35; and a paper sensor detecting a sheet loaded on the manual tray 34.

The feed roller 35 is driven to rotate clockwise in FIG. 1 and the separation roller 36 operates to lead a sheet on the top into the paper feeding path 29 of the main body 101, and transport the sheet toward the register roller 13 until the sheet stops thereat.

The reader 21 has a contact glass 21*a* a document is placed on; a light source (not shown) irradiating the document placed on the contact glass 21*a*; a first scanner 21*b* scanning from side to side in FIG. 1, including a first reflector (not shown) reflecting light reflected from the document irradiated by the light source; a second scanner 21*c* including a second reflector (not shown) reflecting light reflected from a reflector of the first scanner 21*b*; an imaging lens 21*d* imaging light from the second scanner 21*c*; and a reading sensor 21*e* receiving light through the imaging lens 21*d* to read the document.

The automatic document feeder (ADF) 22 has a document table 22*a* a document is placed on, which is turnable to the reader 21 and exposes the contact glass 21*a* when turning above. When a copy is made using the image forming apparatus 100, a document is set on the document table 22*a* of the automatic document feeder (ADF) 22, or a document is manually placed on the contact glass 21*a* after turning the automatic document feeder (ADF) 22 above and it is closed to press the document to the contact glass 21*a*.

The operation panel has a start button starting copying, a ten-key keypad to input the number of copies, a mode selection key selecting image forming modes such as a selection of a full-color image or a black monochrome image, etc.

The controller has a CPU, a memory, etc.

The image forming station 60Y including the photoreceptor drum 20Y will be explained as a representative of the image forming stations 60Y, 60M, 60C and 60BK. Details of the other image forming stations 60M, 60C and 60BK are omitted because they are substantially the same as those of the image forming station 60Y.

Figure 2:
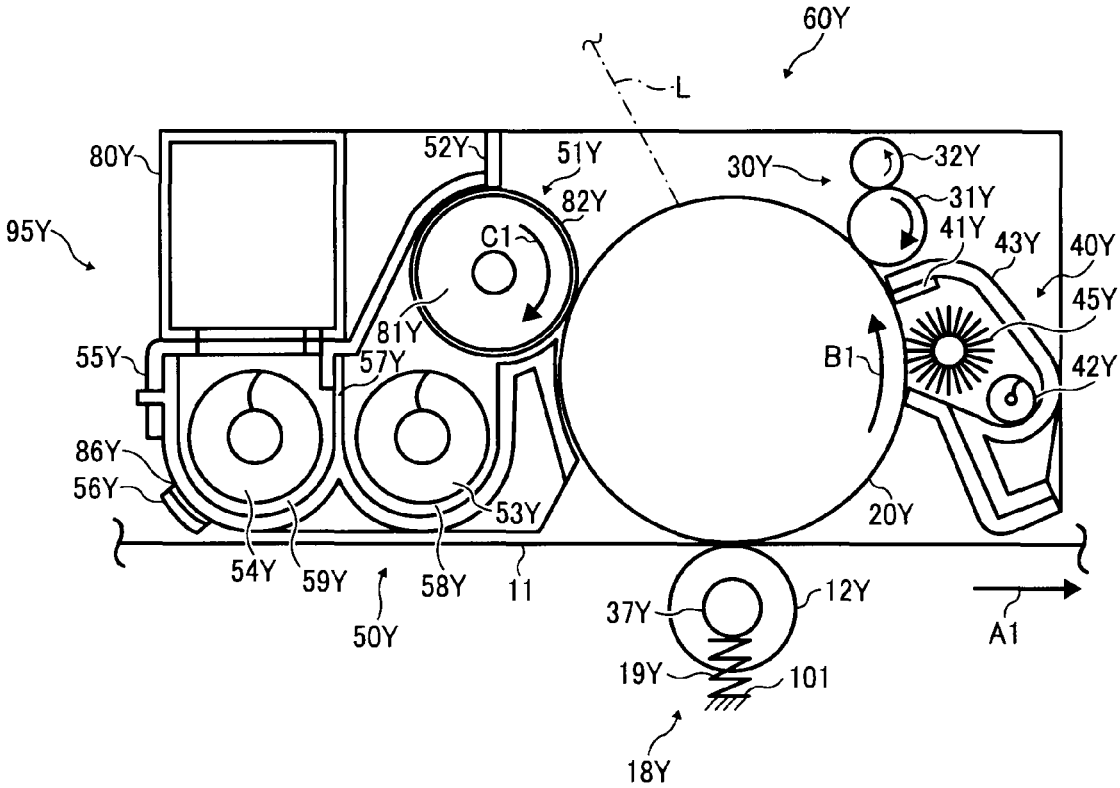
FIG. 2 is a schematic view illustrating a circumference of one of plural image bearers of the image forming apparatus in FIG. 1.

As shown in FIG. 2, the image forming station 60Y including the photoreceptor drum 20Y has a first transfer roller 12Y contacting an intermediate transfer belt 11; a presser 18Y including the first transfer roller 12Y and pressing the intermediate transfer belt 11 to the photoreceptor drum 20Y at a predetermined pressure; a cleaner 40Y; a charger 30Y; an image developer 50Y; and a discharger (not shown) around the photoreceptor drum 20Y along an anticlockwise rotating direction B1 thereof in FIG. 2

The photoreceptor drum 20Y, the cleaner 40Y, the charger 30Y, the image developer 50Y and the discharger are combined to form a process cartridge 95Y. The process cartridge 95Y can be drawn from and set in (detachable from) a main body 101 along a guide rail (not shown).

The process cartridge 95Y is positioned in a predetermined location when set in the main body 101. The process cartridge is preferably used because it can be handled as an exchangeable part noticeably improving its maintenance.

At least the photoreceptor drum 20Y and the image developer 50Y out of the photoreceptor drum 20Y, the cleaner 40Y, the charger 30Y, the image developer 50Y and the discharger are combined to form the process cartridge 95Y, which is a unit detachable from the main body 101.

The charger 30Y has a charging roller 31Y driven to rotate while contacting the surface of the photoreceptor drum 20Y and a cleaning roller 32Y driven to rotate while contacting the charging roller 31Y. A voltage applicator (not shown) applying a DC voltage overlapped with an AC voltage is connected to the charging roller 31Y, and discharges and charges the surface of photoreceptor drum 20Y to have a predetermined polarity in a charging area facing the photoreceptor drum 20Y. The cleaning roller 32Y is driven by the charging roller 31Y to rotate and clean the charging roller 31Y.

In this embodiment, a contact charging roller is used in the charger. However, a close-set charging roller or a non-contact scorotron charging roller may be used.

The first transfer roller 12Y contacts the intermediate transfer belt 11 to press it to the photoreceptor drum 20Y. The first transfer roller 12Y has an axis 37Y which is rotatably supported by the main body 101 and a rotation center thereof. The first transfer roller 12Y has a metallic cored bar (not shown) and an elastic layer (not shown) covering the outer circumferential surface of the cored bar, and the metallic cored bar has the axis 37Y. The first transfer roller 12Y has an ASKER C hardness not greater than 50 with the elastic layer. A bias applicator having an electric source (not shown) and a bias controller (not shown) apply a predetermined bias to the first transfer roller 12Y. The axis 37Y extends in a direction perpendicular to the drawing, i.e., a main scanning direction, which is an axial direction of the first transfer roller 12Y.

Besides the first transfer roller 12Y, the presser 18Y has a press spring 19Y as a biasing means biasing the axis 37Y toward the intermediate transfer belt 11 between the axis 37Y and the main body 101; and a holder (not shown) displaceably holding the axis 37Y in the vertical direction. The presser 18Y presses the intermediate transfer belt 11 to the photoreceptor drum 20Y vertically and upward with a biasing force through the first transfer roller 12Y. The pressure at which the press spring 19Y presses the intermediate transfer belt 11 to the photoreceptor drum 20Y will be mentioned later as a first transfer pressure in FIGS. 3 and 4.

The optical scanner 8 in FIG. 1 irradiates an area between a charged area and a developing area of the photoreceptor drum 20Y with a laser beam L optically-modulated according to image information in FIG. 2 such that the surface of the photoreceptor drum 20Y after charged by the charging roller 31Y is exposed with the laser beam L to form an electrostatic latent image to be visualized (developed) by the image developer 50Y as a yellow toner image.

The cleaner 40Y has a cleaning case 43Y having an opening facing the photoreceptor drum 20Y; a rotating brush roller 45Y contacting the photoreceptor drum 20Y to scrape a toner, a carrier and a paper powder remaining thereon; a cleaning blade 41Y contacting the photoreceptor drum 20Y at a downstream position in a rotating direction B1 thereof to scrape undesired substances thereon.

The cleaner 40Y also has a discharge screw 42Y rotatably held by the cleaning case 43Y, forming a part of a waste toner path (not shown) for transporting undesired substances such as a waste toner scraped and removed by the rotating brush roller 45Y and the cleaning blade 41Y.

The image developer 50Y has a developer case 55Y having an opening facing the photoreceptor drum 20Y; a developing roller 51Y as a developer bearer closely facing the photoreceptor drum 20Y from the opening; and a developer doctor blade 52Y as a regulator regulating the height of the developer on the developing roller 51Y.

The image developer 50Y also has a first feed screw 53Y and a second feed screw 54Y facing each other at the bottom of the developer case 55Y and being rotated in the reverse direction each other to stir the developer and feed the developer to the developing roller 51Y; a partition 57Y between the first feed screw 53Y and the second feed screw 54Y; and a first container 58Y and a second container 59Y containing the developer, partitioned by the partition 57Y, including the first feed screw 53Y and the second feed screw 54Y.

Further, the image developer 50Y has a toner hopper 80Y storing a yellow toner; a toner concentration sensor 56Y located at the bottom of the second container 59Y, detecting toner concentration in the developer; a double-sided tape 86Y taping the toner concentration sensor 56Y to the second container 59Y.

Furthermore, the image developer 50Y has a bias applicator (not shown) applying a DC developing bias; a driver (not shown) driving the developing roller 51Y; a feed driver (not shown) rotating the first feed screw 53Y and the second feed screw 54Y in the reverse direction each other; and a toner feeder (not shown) feeding the toner from the toner hopper 80Y to the second container 59Y.

The developing roller 51Y has a magnet roller 81Y generating a magnetic field; and a developing sleeve 82Y including the magnet roller 81Y and being rotated in the clockwise direction C1 by a developing driver in FIG. 2.

The magnet roller 81Y has a plastic roller (not shown) fixed on the developer case 55Y and plural magnet blocks (not shown) buried in the plastic roller, forming plural magnetic poles.

The developing sleeve 82Y is rotatably held by the developer case 55Y and the magnet roller 81Y.

A suitable developing bias is applied by a bias applicator between the developing sleeve 82Y and the photoreceptor drum 20Y. A (developing) gap between the developing sleeve 82Y and the photoreceptor drum 20Y in a developing area is designed to be 0.3±0.05 mm.

The developer doctor blade 52Y is formed of a SUS material. A (doctor) gap between the developing sleeve 82Y and the developer doctor blade 52Y is designed to be 0.5±0.04 mm.

The developer is a two-component developer including a toner and a carrier.

The carrier is a magnetic carrier including a core material and a resin coated layer formed on the surface of the core material. The resin coated layer includes an electroconductive particulate material formed of a substrate, a tin dioxide layer on the substrate, and an indium oxide layer including tin dioxide on the tin dioxide layer.

The toner will be mentioned later in detail.

The toner concentration in the developer is constantly controlled to have about 4 to 11% by weight based on total weight of the developer (to the weight of the carrier) based on the detection of the toner concentration sensor 56Y as mentioned later, which produce high-quality images. The toner concentration lowers as the toner is consumed, and when the toner concentration sensor 56Y detects the toner concentration is lower than the minimum, the toner is fed from the toner hopper 80Y to the second container 59Y by the toner feeder.

The first feed screw 53Y and the second feed screw 54Y extend in the width direction of the developing roller 51Y, in other words, in the longitudinal direction thereof perpendicular to the drawing in FIG. 2.

The first feed screw 53Y is rotated by the feed driver to feed the developer in the first container 58Y to the developing roller 51Y while transporting the developer from behind to the front in FIG. 2. The developer transported by the first feed screw 53Y near the end of the first container 58Y enters the second container 59Y through an opening (not shown) on the partition 57Y.

The second feed screw 54Y is rotated by the feed driver in the second container 59Y to transport the developer transported from the first container 58Y in the reverse direction of the first feed screw 53Y. When the toner is fed into the second feed screw 54Y from the toner hopper 80Y, the second feed screw 54Y transports the developer while stirring and mixing the toner in the developer. The developer transported by the first feed screw 54Y near the end of the first container 58Y returns into the second container 59Y through another opening (not shown) on the partition 57Y.

The toner is stirred and mixed with the developer by the first feed screw 53Y and the second feed screw 54Y to be charged and borne by the developing roller 51Y.

The developing roller 51Y bearing the developer having an amount and a thickness regulated by the developer doctor blade 52Y transports the developer with its rotation and a developing bias from the bias applicator to a developing area between the developing roller 51Y and the photoreceptor drum 20Y. A yellow toner in the developer is electrostatically transferred to an electrostatic latent image formed on the photoreceptor drum 20Y to visualize the electrostatic latent image as a yellow toner image.

The developer having transferred the yellow toner for developing is returned into the image developer 50Y with the rotation of the developing roller 51Y.

In this embodiment, the bias applicator applies a DC developing bias. The developing bias may be an AC bias, and a DC bias may be overlapped with an AC bias.

Thus, the developer stirred and transported by the first feed screw 53Y and the second feed screw 54Y in the image developer 50Y is drawn by the magnetic force of the magnet roller 81Y, borne by the developing sleeve 82Y, transported the developing area facing the photoreceptor drum 20Y, and a toner is fed to a latent image thereon. The developer having transferred the toner after development is freed in the first container 58Y from the surface of the developing sleeve 82Y, stirred with the developers in the first container 58Y and the second container 59Y by the first feed screw 53Y and the second feed screw 54Y, respectively to be drawn to the surface of the developing sleeve 82Y again. The magnet block is located to repeat such a cycle.

In such a cycle, the toner in the developer is consumed and the concentration thereof lowers. The toner concentration is detected by the toner concentration sensor 56Y.

The toner concentration sensor 56Y measures the toner concentration (% by weight) with a magnetic permeability of the developer, producing a voltage (Vout) to be put in a controller.

A developer including a toner and a magnetic carrier has a high magnetic permeability when the toner concentration is low because a ratio of the carrier increases. The magnetic permeability becomes low when the toner concentration is high because the ratio of the carrier lowers. Therefore, the toner concentration and the voltage (Vout) are in direct proportion to each other.

When the controller detects lowering the toner concentration based on the voltage (Vout) from the toner concentration sensor 56Y, the controller drives the toner feeder to feed the toner from the toner hopper 80Y to the second container 59Y until the voltage (Vout) recovers to have a predetermined value.

When a copy is made using the image forming apparatus 100, a start button is pushed while setting a document on the automatic document feeder (ADF) 22 as mentioned above, or manually placing a document on the contact glass 21*a*. When the image forming apparatus 100 is used as a printer, image data are selected and input by outer input devices such as a PC connected thereto to start producing images.

When a document is set on the automatic document feeder (ADF) 22, the document is fed onto the contact glass 21*a* to be read by the reader 21. When a document is placed on the contact glass 21*a*, a start button is pushed such that the reader 21 reads the document to produce image data.

When the document is read, the first scanner 21*b* and the second scanner 21*c* scan, the document is irradiated with light from the light source, the first reflector reflects light reflected from the document toward the second scanner 21*c*, the second reflector turns the direction of the light by 180 degrees toward the reading sensor 21*e* through the imaging lens 21*d*, and the document is read by the reading sensor 21*e*.

The above-mentioned image forming stations 60Y, 60M, 60C and 60BK operate based on image data produced or input.

In the image forming station 60Y, the surface of the photoreceptor drum 20Y is uniformly charged by the charging roller 31Y with the rotation in the direction B1. The optical scanner 8 irradiates the photoreceptor drum 20Y with a laser beam L to form an electrostatic latent image for yellow color thereon. The electrostatic latent image is developed by the image developer 50Y with a yellow color toner to form a yellow color toner image. The yellow color toner image is first transferred by the first transfer roller 12Y onto the intermediate transfer belt 11 traveling in the direction A1. Undesired substances including a toner remaining on the photoreceptor drum 20Y after transferred are removed by the cleaner 40Y, and the photoreceptor drum 20Y is discharged.

Each color toner image is formed on each of other photoreceptors 20C, 20M and 20BK, and each color toner image is first transferred by each of the first transfer rollers 12C, 12M and 12Bk, respectively on the same position of the intermediate transfer belt 11 traveling in the direction A1 to form a fill-color toner image. The toner images overlapped on the intermediate transfer belt 11 are transported to a second transfer nip facing the second transfer roller 17 with the rotation thereof in the direction A1 to be secondly transferred onto a sheet.

The sheet fed between the intermediate transfer belt 11 and the second transfer roller 17 is a sheet fed from the paper feeding cassette 25 by the rotation of the selected feed roller 24 which is one of the sheet feeder 23, a sheet fed by the rotation of the feed roller 35 of the manual paper feeder 33 from the manual tray 34, or a sheet fed by the paper feed roller 95 from the both side printing unit 96. The sheet is fed by the pair of register rollers such that the end of a toner image on the intermediate transfer belt 11 faces the second transfer roller 17 based on a detection signal of the sensor.

The sheet all color toner images are transferred on and bearing them is transported by the transporter 76 to enter the fixer 6, where the toner images borne by the sheet are fixed thereon with heat and pressure when passing a fixing area between the fixing belt 64 and the pressure roller 63 to form a color image thereon.

The sheet the toner images are fixed on is stacked on the discharged paper tray 75 through the paper discharging roller 98 or enters the both side printing unit 96 through the transport roller 97 to be ready to be printed on the other side in accordance with a position of the switcher 94. On the other hand, a toner remaining on the intermediate transfer belt 11 after the second transfer is removed therefrom by the intermediate transfer belt cleaner 14, and the intermediate transfer belt 11 is ready to form a following image.

The toner included in the two-component developer for use in the image forming apparatus 100 will be explained.

The toner is not particularly limited and toners prepared by conventional known methods can be used, provided they satisfy the requirements of the present invention. In addition, conventional known binder resins and colorants can be used for the toner, provided they satisfy the requirements thereof.

Specific examples of the binder resins include polyester resins, styrene resins, acrylic resins, styrene-acrylic resins, polyol resins, epoxy resins, etc. Particularly, the polyester resins are preferably used in terms of their low-temperature fixability. The binder resin preferably has a glass transition temperature (Tg) of from 40 to 75° C., and more preferably from 45 to 65° C. When Tg is too low, the heat resistant preservability of the resultant toner deteriorates. When too high, the low-temperature fixability of the resultant toner deteriorates. Tg can be determined from a DSC curve obtained at a rate of temperature increase of 10° C./min using a differential scanning calorimeter (DSC) DSC-60A from Shimadzu Corp.

Specific examples of the colorants for use in the present invention include any known dyes and pigments such as carbon black, Nigrosine dyes, NAPHTHOL YELLOW, HANSA YELLOW, polyazo yellow, Oil Yellow, Pigment Yellow, PERMANENT YELLOW, Brilliant Carmine, PERMANENT RED, Oil Red, Quinacridone Red, Pyrazolone Red, polyazo red, Phthalocyanine Blue, Anthraquinone Blue, Anthraquinone Violet, Naphthol Green, Phthalocyanine Green, etc. The toner preferably include the colorant in an amount of from 0.5 to 15% by weight, and more preferably from 3 to 10% by weight. The colorant for use in the present invention can be used as a masterbatch when combined with a resin. The resin used for preparing the masterbatch is typically the same as the binder resin of the toner, but not particularly limited.

The toner may include a release agent together with the binder resin and the colorant. Specific examples thereof include known release agents such as polyethylene wax, polypropylene wax, paraffin wax, sasol wax, carnauba wax, montan wax, etc. The toner preferably includes a release agent in an amount of from 0 to 40% by weight, and more preferably from 5 to 20% by weight.

Further, the toner may include a charge controlling agent if desired. Specific examples thereof include any known charge controlling agents such as Nigrosine dyes, triphenylmethane dyes, metal complex dyes including chromium, molybdic acid chelate pigments, quaternary ammonium salts, fluorine-modified quaternary ammonium salts, and metal salts of salicylic acid and of salicylic acid derivatives, etc.

The content of the charge controlling agent is determined depending on the species of the binder resin used, whether or not an additive is added and toner manufacturing method (such as dispersion method) used, and is not particularly limited. However, the toner preferably includes the charge controlling agent in an amount of from 0.1 to 10% by weight, and more preferably from 0.2 to 5% by weight. The charge controlling agent may be dispersed in a toner, externally added to the surface thereof or fixed thereon.

Further, optional inorganic particulate materials may be externally added to the toner for the purpose of the fluidity, developability and chargeability thereof. The inorganic particulate material preferably has a primary particle diameter of from 5 nm to 2 μm, and is preferably included in the toner in an amount of from 0.01 to 5% by weight based on total weight thereof. Specific examples of the inorganic particulate material include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc. These can be used alone or in combination.

A toner including a polyester resin prepared by an ester elongation polymerization method, having good low-temperature fixability as a binder resin is most preferably used in the image forming apparatus 100.

This is because, as mentioned previously, the recent demand for saving resources and energy is so strong that a toner formed of a resin powder is having a lower softening point to be fixed with a lower energy.

The ester elongation polymerization method is a method of preparing a toner, including dispersing an organic solvent phase including a polyester prepolymer in an aqueous medium phase with a compound including an active hydrogen to be subjected to an elongation and/or a crosslinking reaction; removing the organic solvent; and washing and drying. This method has good granulatability, and can control the particle diameter, the particle diameter distribution and the shape of a toner with ease. Hereinafter, the above-mentioned method and materials used therein will be explained.

The polyester prepolymer is a component forming a more polymeric toner binder when subjected to an elongation and/or a crosslinking reaction with the compound including an active hydrogen in the aqueous medium. The polyester prepolymers include a polyester prepolymer having a functional group such as an isocyanate group reacting with an active hydrogen, etc.

The polyester prepolymer having an isocyanate group is preferably used. The polyester prepolymer can be formed from a reaction between polyester which is a polycondensate between polyol (PO) and a polycarboxylic acid (PC) and has an active hydrogen atom, and polyisocyanate (PIC). Specific examples of the polycondensate between polyol (PO) and a polycarboxylic acid (PC) having an active hydrogen atom include adducts of bisphenol A with alkylene oxide; dicarboxylic acids such as a succinic acid, an adipic acid, a maleic acid, a fumaric acid, a phthalic acid and a terephthalic acid; and polycarboxylic acids such as a trimellitic acid and a pyromellitic acid.

Specific examples of the PIC include aliphatic polyisocyanate such as tetramethylenediisocyanate, hexamethylenediisocyanate and 2,6-diisocyanatemethylcaproate; alicyclicpolyisocyanate such as isophoronediisocyanate and cyclohexylmethanediisocyanate; aromatic diisocyanate such as tolylenedisocyanate and diphenylmethanediisocyanate; aroma aliphatic diisocyanate such as α,α,α',α'-tetramethylxylylenediisocyanate; isocyanurate; the above-mentioned polyisocyanate blocked with phenol derivatives, oxime and caprolactam; and their combinations.

The polyester prepolymer typically includes one or more, preferably from 1.5 to 3, and more preferably from 1.8 to 2.5 isocyanate groups per molecule. When less than 1, the molecular weight of the polyester lowers after the elongation reaction, and the hot offset resistance of the resultant toner deteriorates. The polyester prepolymer is dissolved in an organic solvent phase as mentioned above, and the content thereof is from 10 to 55% by weight, preferably from 10 to 40% by weight, and more preferably from 15 to 30% by weight per 100% by weight of the toner.

An unreactive polyester is more preferably dissolved with the polyester prepolymer than only the polyester prepolymer is dissolved in the organic solvent phase to improve the low-temperature fixability and glossiness of the resultant toner when used for forming full-color images.

Specific examples of the unreactive polyester include the above-mentioned polycondensates between polyol (PO) and a polycarboxylic acid (PC).

A ratio (PP/UP) of the polyester prepolymer (PP) to the unreactive polyester (UP), which are dissolved in an organic solvent phase is from 10/90 to 55/45, preferably from 10/90 to 40/60, and furthermore preferably from 15/85 to 30/70 by weight. When the ratio of the polyester prepolymer is too low, the hot offset resistance of the resultant toner deteriorates, and the heat resistant preservability and low-temperature fixability are difficult to be compatible. Other known toner binder resins except the unreactive polyester, such as a styrene resin, an acrylic resin, an epoxy resin and a styrene-acrylic acid ester copolymer may be used.

Amines are preferably used as the compound including an active hydrogen, and are reacted with the isocyanate group of the polyester prepolymer to form urea-modified polyester resins. Specific examples of the amines include diamines, polyamines having three or more amino groups, amino alcohols, amino mercaptans, amino acids and blocked amines in which the amines mentioned above are blocked. 4,4'-diaminodiphenyl methane, isophorone diamine, hexamethylene diamine, ethanol amine, aminoethyl mercaptan, amino propionic acid, and ketimine compounds which are prepared by blocking the amines with ketones such as methyl ethyl ketone preferably used.

It is most preferable that the colorant or the masterbatch is previously dissolved or dispersed with the polyester prepolymer and the unreactive polyester in an organic solvent phase. In addition, the release agent and the charge controlling agent may previously be dissolved or dispersed therein if desired.

The aqueous medium includes water alone and mixtures of water with a solvent. Particularly, in order to lower the viscosity of the resin components included in the above-mentioned organic solvent phase when dispersed in an aqueous medium, the solvent preferably dissolves the resin components. The solvent is preferably a volatile solvent having a boiling point less than 100° C. because it can easily be removed. Specific examples of such a solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone, etc. These solvents can be used alone or in combination.

A particulate resin is preferably dispersed in the aqueous medium. The particulate resin is used for the purpose of controlling the shape of a toner such as circularity and particle diameter distribution, and mainly located on the surface of a toner. Specific examples of the organic particulate resin include any thermoplastic and thermosetting resins capable of forming a dispersion element such as vinyl resins, a polyurethane resin, an epoxy resin, a polyester resin, a polyamide resin, a polyimide resin, silicon resins, a phenol resin, a melamine resin, a urea resin, an aniline resin, an ionomer resin, a polycarbonate resin, etc. These resins can be used alone or in combination. Among these resins, the vinyl resins, the polyurethane resin, the epoxy resin, the polyester resin and their combinations are preferably used in terms of forming an aqueous dispersion of microscopic spherical particulate resins.

Specific examples of the vinyl resins include homopolymerized or copolymerized polymers such as styrene-(metha) esteracrylate resins, styrene-butadiene copolymers, (metha) acrylic acid-esteracrylate polymers, styrene-acrylonitrile copolymers, styrene-maleic acid anhydride copolymers and styrene-(metha)acrylic acid copolymers.

The particulate resin is preferably dispersed in an aqueous medium in an amount of from 0.5 to 10% by weight based on total weight of the organic solvent phase. When not, the organic solvent phase is too poorly emulsified in the aqueous medium to granulate. More preferably from 1 to 3% by weight. The particulate resin preferably has an average particle diameter of from 5 to 200 nm, and more preferably from 20 to 300 nm in terms of granulation. In addition, the particulate resin preferably has a glass transition temperature (Tg) of from 40 to 90° C., and more preferably from 50 to 70° C. in terms of the low-temperature fixability and preservability of the resultant toner.

The particle diameter and circularity of a toner are measured by the following methods.

The weight-average particle diameter and number average particle diameter of a toner are measured by Coulter Multisizer II from Beckman Coulter, Inc. as follows:

0.1 to 5 ml of a detergent, preferably alkylbenzene sulfonate is included as a dispersant in 100 to 150 ml of the electrolyte ISOTON R-II from Coulter Scientific Japan, Ltd., which is a NaCl aqueous solution including an elemental sodium content of 1%;

2 to 20 mg of a toner sample is included in the electrolyte to be suspended therein, and the suspended toner is dispersed by an ultrasonic disperser for about 1 to 3 min to prepare a sample dispersion liquid; and a volume and a number of the toner particles are measured by the above-mentioned measurer using an aperture of 100 μm to determine a weight distribution and a number distribution. weight-average particle ($D_4$) diameter and a number-average particle diameter of a toner can determined therefrom.

The number of measurement counts is 50,000 counts.

The circularity of the toner is measured by FPIA-2100 from SYSMEX CORPORATION and an analysis software FPIA-2100 Data Processing Program for FPIA version 00-10 was used. Specifically, 0.1 to 0.5 g of the toner and 0.5 ml of a surfactant (alkylbenzenesulfonate Neogen SC-A from Daiichi Kogyo Seiyaku Co., Ltd.) having a concentration of 10% by weight were mixed with a micro spatel in a glass beaker having a capacity of 100 ml, and 80 ml of ion-exchange water was added to the mixture. The mixture was dispersed by an ultrasonic disperser W-113MK-II from HONDA ELECTRONICS CO., LTD. for 3 min. The circularity of the toner was measured by FPIA-2100 until the dispersion has a concentration of from 5,000 to 15,000 pieces/μl, which is essential in terms of measurement reproducibility of the average circularity. In order to obtain the concentration, it is necessary to control added amounts of the surfactant and the toner. The amount of the surfactant depends on the hydrophobicity of the toner. When too much, bubbles cause noises. When short, the toner is not sufficiently wetted and not sufficiently dispersed. The amount of the toner depends on the particle diameter thereof. When small, the amount needs to be less. When large, the amount needs to be more. When the toner has a particle diameter of from 3 to 7 μm, the amount thereof is 0.1 to 0.5 g such that the dispersion has a concentration of from 5,000 to 15,000 pieces/μl.

As previously mentioned, when comparatively a soft polyester resin is used as a toner binder, the burial of an additive occasionally affects the transferability of the toner.

An additive burial rate is known as an index representing buriability of an additive. Hereinafter, the additive burial rate will be explained.

The additive burial rate is an index representing a degree of an external additive burying in a toner due to a stirring stress in an image developer as time passes. When the surface of a toner has low mechanical strength and an additive is likely to bury therein, the additive burial rate is high. The toner an additive is difficult to bury in has a low additive burial rate.

The additive burial rate X indicated by the following formula:

$$X=(A-B)/A\times 100$$

wherein A represents a BET specific surface area ($cm^2/g$) of the toner; and B represents a BET specific surface area ($cm^2/g$) of the toner after buried.

The additive is buried as follows.

10 g of the toner including an additive and 100 g of a resin-coated ferrite carrier were placed in an ointment bottle having an inner capacity of from 300 to 500 ml, and they are mixed by a Tubular Mixer for 30 min at 100 rpm.

Conventionally known resin-coated ferrite carriers can be used as the resin-coated ferrite carrier, and a ferrite carrier coated with a silicone resin EF963-60B from Powdertech Co., Ltd. is used in the present invention.

Tubular Mixer T2F from Willy A. Bachofen GmbH is used as the Tubular Mixer.

After they are mixed for 30 min, 300 ml of water are added in the ointment bottle made of polyethylene and the toner and the carrier are separated in the water by lightly stirring the mixture with a stirrer. The toner dispersion, i.e., a supernatant solution therein is filtered to prepare a toner. The toner is dried under depressure at room temperature to prepare a toner after the additive is buried therein.

The BET specific surface areas of the toner and the toner after the additive is buried therein are measured by an automatic surface area/pore distribution measurer TriStar 3000 from Shimadzu Corp. Specifically, 1 g of the toner is placed in an own cell, and the cell is deaerated by an own degassing unit VacuPrep 061 from Shimadzu Corp. The cell is deaerated under depressure at 100 mtorr or less for 20 hrs at room temperature. The BET specific surface area of the toner in the deaerated cell is automatically measured by TriStar 3000. Nitrogen gas is used as an absorption gas.

The toner for use in the present invention has an additive burial rate of 42%.

The toner is prepared by the following method.

950 parts of water, 20 parts of a water dispersion of a copolymer of styrene-methacrylic acid-butylacrylate-sodium salt of sulfate oxide adduct of methacrylic acid, 16 parts of of an aqueous solution of sodium dodecyldiphenyletherdisulfonate having a concentration of 48.5% (ELEMINOL MON-7 from Sanyo Chemical Industries, Ltd.), 12 parts of an aqueous solution having a concentration of 3.0% by weight of a polymeric protective colloid carboxymethylcellulose sodium (Selogen BSH from Sanyo Chemical Industries, Ltd.) and 130 parts of ethylacetate are mixed and stirred to prepare a lacteous liquid (aqueous phase).

1,200 parts of water, 50 parts of carbon black (REGAL 400R from Cabot Corp.), 50 parts of a polyester resin (RS801 from Sanyo Chemical Industries, Ltd.) are mixed by a HENSCHEL mixer (from Mitsui Mining Co., Ltd.) with additional 30 parts of water to prepare a mixture. The mixture is kneaded by a two-roll mil having a surface temperature of 150° C. for 30 min, extended upon application of pressure, cooled and pulverized by a pulverizer to prepare a carbon black masterbatch.

500 parts of a polyester resin (RS801 from Sanyo Chemical Industries, Ltd., having a weight-average molecular weight of 19,000 and a Tg of 64° C.), 30 parts of carnauba wax and 850 parts of ethylacetate are mixed in a container including a stirrer and a thermometer. The mixture is heated to have a temperature of 80° C. while stirred. After the temperature of 80° C. is maintained for 5 hrs, the mixture is cooled to have a temperature of 30° C. in an hour. The carnauba wax is dispersed by a beads mill (Ultra Visco Mill from IMECS CO., LTD.) for 3 passes under the following conditions:

liquid feeding speed of 1.2 kg/hr peripheral disc speed of 8 m/sec, and filling zirconia beads having diameter 0.5 mm by 80% by volume.

Next, 110 parts of the carbon black masterbatch and 500 parts of ethylacetate are placed in the container and mixed therein for 1 hr to prepare a solution. The, 240 parts of ethylacetate are further added thereto, and the solution is dispersed by the beads mill for 3 passes at a liquid feeding speed of 1.2 kg/hr, a peripheral disc speed of 8 m/sec, and a filling amount of zirconia beads having diameter 0.5 mm of 80% by volume to prepare a dispersion (oil phase).

1,780 parts of the oil phase, 100 parts of a polyester prepolymer ethylacetate solution having a concentration of 50% (from Sanyo Chemical Industries, Ltd., having a weight-average molecular weight of 3,800, a weight-average molecular weight of 15,000 and a Tg of 60° C.), 15 parts of isobutylalcohol and 7.5 parts of isophoronediamine are mixed in a container by TK HOMOMIXER from TOKUSHU KIKA KOGYO CO., LTD. at 6,000 rpm for 1 min to prepare a mixture. Then, 1,200 parts of water are added in the container and the mixture is mixed by TK HOMOMIXER at 7,500 rpm for 20 min to prepare an aqueous medium dispersion.

The aqueous medium dispersion is placed in a container including a stirrer and a thermometer, subjected to de-solvent at 30° C. for 12 hrs, and aged at 45° C. for 8 hrs to prepare a dispersion the organic solvent is removed from. 100 parts of the dispersion are filtered under reduced pressure to prepare a filtered cake, and 500 parts of ion-exchanged water are added to the filtered cake to prepare a mixture. The mixture is mixed by TK HOMOMIXER from at 12,000 rpm for 10 min and filtered under reduced pressure again. The filtered cake was dried by an air drier at 45° C. for 48 hrs and sieved by a mesh having an opening of 75 μm to prepare parent toner particles.

The toner has a weight-average particle diameter ($D_4$) of 5.8 μm, a number-average particle diameter of 5.1 μm, an average circularity of 0.97 and an additive burial rate of 42%. The methods of measuring these are already mentioned.

The additive burial rate can be controlled by adjusting the molecular weight of the resin. For examples, when the polyester resin (RS801 from Sanyo Chemical Industries, Ltd., having a weight-average molecular weight of 19,000 and a Tg of 64° C.) is replaced by a polyester resin (from Sanyo Chemical Industries, Ltd., having a weight-average molecular weight of 12,000 and a Tg of 56° C.), the resultant toner has a weight-average particle diameter ($D_4$) of 5.7 μm, a number-average particle diameter of 5.1 μm, an average circularity of 0.98 and an additive burial rate of 56%. When the polyester resin is replaced by a styrene-acrylic resin, the resultant toner has an additive burial rate of 30%.

As mentioned already, an image forming system producing high-quality and high-definition images for long periods is desired even with comparatively a soft toner an external additive is likely to bury in. On the other hand, atoner image is required to faithfully and stably transfer from an image bearer to an intermediate transferer, and to a sheet therefrom. Adjusting a pressure of pressing the intermediate transferer to the surface of the image bearer affects the performance of the second transfer.

In consideration of the influence upon the performance of the second transfer in the image forming apparatus 100 using a two-component developer including a soft toner, various experiments were made to determine a suitable pressure of the first transfer for forming quality images. The first transfer pressure was adjusted by changing a pressure of each press spring of each presser pressing the intermediate transfer belt 11 to the photoreceptor drums 20Y, 20M, 20C and 20BK. The press spring for the photoreceptor drum 20Y was the above-mentioned press spring 19Y.

The first transfer pressures were actual pressures of the first transfer roller 12Y, 12M, 12C and 12BK pressing the intermediate transfer belt 11. In the present invention, since the first transfer rollers 12Y, 12M, 12C and 12BK contact the intermediate transfer belt 11 upward in the vertical direction, the first transfer pressures are pressures obtained by reducing weights of the first transfer rollers 12Y, 12M, 12C and 12BK from the pressures of the press springs.

In addition, including elastic layers having an ASKER C hardness of 50 or less hardness, the first transfer rollers 12Y, 12M, 12C and 12BK are likely to dent and have larger areas contacting the intermediate transfer belt 11. Therefore, even when a balance of the first transfer pressure lowers in the axial directions of the first transfer rollers 12Y, 12M, 12C and 12BK due a tolerance of formation and composition thereof or the first transfer pressures are out of desired pressures, deterioration of the second transfer performance is prevented or controlled to produce quality images. Therefore, the first transfer pressure can be lowered.

Experimental results are shown in FIGS. 3 to 5. Examples include conditions of producing quality or comparatively quality images, which are applicable to the image forming apparatus 100 of the present invention. Comparative Examples include conditions of producing not quality images.

The hollow level means a level of a defective hollow image line images and central images drop off from. The grainy level means a level of a defective nonsmooth image. The levels are graded on a scale of 1 to 5. The level 1 is worst, and 5 is best. The tolerance level is 4 or 5.

FIG. 3 is a Table showing evaluation results of grainy and hollow images when the first transfer pressures were varied. 1C represents a time when one color image was formed and 2C represents a time when two color images were overlappingly formed.

In FIG. 3, in Comparative Examples 1 to 3, the first transfer pressure of each color was equal to those of other colors. The pressure in Example 2 was lower than that in Example 1, and the pressure in Example 3 was even lower than that in Example 2. The hollow level in Comparative Example 1 had no problem, the grainy levels of magenta and cyan therein were not acceptable. Since a soft toner is typically deformable, the toner has a large area contacting the intermediate transfer belt 11 and adheres thereto more when the first transfer pressure is high. Therefore, grainy or hollow images are likely to be produced.

In Comparative Examples 2 and 3, the grainy levels were improved more than that in Comparative Example 1, but the hollow image of 2C was not acceptable. This is because a low first transfer pressure lowered the adherence of a toner to the intermediate transfer belt 11 and the second transfer performance was improved to reduce the grainy images, but the low first transfer pressure was insufficient for overlapping two color toners, resulting in defective transfers as hollow images.

In Examples 1 and 2 lowering only the first transfer pressure of a black toner finally transferred, both of the grainy and hollow images improved to be in the tolerance level. This is because, as mentioned above, a low first transfer pressure lowered the adherence of a toner to the intermediate transfer belt 11 and the second transfer performance was improved to reduce the grainy images and lowering only the first transfer pressure of a black toner did not cause defective transfers as hollow images.

Since a black toner is rarely overlapped with other color toners on the intermediate transfer belt 11 or a sheet, lowering only the first transfer pressure of a black toner is thought not to cause hollow images.

From a comparison between Example 1 and Comparative Example 2, and Example 2 and Comparative Example 3, the grainy levels were slightly poorer than when the pressures for all colors were lowered.

A toner used in this evaluation had an additive burial rate of 42%. The intermediate transfer belt 11 was formed of a polyimide resin, and had a volume resistivity of $1\times10^{9}$ Ω·cm and a surface resistivity of $1\times10^{11}$Ω/□.

FIG. 4 is also a Table showing evaluation results of grainy and hollow images, in which burial rates of additives of toners are varied as well, which is different from FIG. 3. In addition, fixability at a low temperature and a low humidity of each Example was evaluated. The first transfer pressures in all Comparative Examples in FIG. 4 were 100 g/cm$^2$.

Toners used in Comparative Examples 4 to 6 had an additive burial rate less than 40%. The hollow level in each thereof had no problem, but the fixability at a low temperature and a low humidity (10° C., 15%) therein was insufficient.

Comparative Examples 7 to 9 using toners having additive burial rates not less than 40% had no hollow image problem, and the fixability at a low temperature and a low humidity in each thereof improved. However, the grainy levels were all worsened and unacceptable.

Examples 3 to 5 using toners having additive burial rates not less than 40% and lowering only the first transfer pressure of a black toner reached the tolerance levels in both of the grainy and hollow images. The fixability at low temperature and low humidity in each thereof was also good.

Polyester resins form a toner having low mechanical strength, high additive burial rate and low-temperature fixability.

The intermediate transfer belt 11 was formed of a polyimide resin, and had a volume resistivity of $1\times10^{9}$ Ω·cm and a surface resistivity of $1\times10^{11}$Ω/□.

FIG. 5 is a Table showing evaluation results of grainy levels of two-color layered images when color orders are varied. ○ represents a tolerance level of grainy images, and × represents an unacceptable level. Overlapped two color images, a red image (yellow+magenta), a green image (yellow+cyan) and a blue image (magenta+cyan) were evaluated. YMCK represents a case where a yellow image, a magenta image, a cyan image and a black image are formed and first-transferred in this order from the upstream of the traveling direction A1 of the intermediate transfer belt.

Only when a yellow image, a magenta image, a cyan image and a black image are formed in this order, grainy levels of the overlapped two color images (red, green and blue) are acceptable.

This is because:

when yellow is overlapped with magenta, the resultant image becomes red and the magenta background is undistinguished even when yellow comes off;

when yellow is overlapped with cyan, the resultant image becomes green and the cyan background is undistinguished even when yellow comes off; and when magenta is overlapped with cyan, the resultant image becomes blue and the cyan background is undistinguished even when magenta comes off.

Other color orders cause grainy images, e.g., when cyan is overlapped with magenta, the resultant image becomes blue and the magenta background is distinguished when cyan comes off.

From the upstream in the direction A1, from undistinguished colors to distinguished colors are preferably formed. A transfer bias is likely to disturb an image located upstream in the direction A1, and a disturbed image is undistinguished because from undistinguished colors to distinguished colors are formed from the upstream in the direction A1. In addition, even when a color toner on the upstream side of the direction A1 adheres to an image bearer for a color toner on the downstream side therein, the color toner on the upstream side is undistinguished and not likely to cause defective images.

A toner used in Example 6 and Comparative Examples 10 to 12 had a additive burial rates of 42%. The intermediate transfer belt 11 was formed of a polyimide resin, and had a volume resistivity of $1\times10^{9}$ Ω·cm and a surface resistivity of $1\times10^{11}$Ω/□.

From the above-mentioned experimental results, conditions for producing quality images are as follows.

It is essential that a toner has an additive burial rate not less than 40% and that a first transfer pressure of a black toner image is lower than first transfer pressures of other color toner images.

As mentioned above, in consideration of the distinguished black toner largely influencing the resultant images when adhering to the photoreceptor drums 20Y, 20M and 20C, the black toner image is preferably transferred onto the intermediate transfer belt 11 last. The first transfer pressure of the black toner image lower than those of the other color toner images is applied last to improve the grainy and hollow images.

In addition, a yellow toner image is preferably transferred onto the intermediate transfer belt 11 first because yellow is most undistinguished and the grainy levels are improved.

Further, it is preferable that a magenta toner image and a cyan toner image are transferred onto the intermediate transfer belt 11 secondly and thirdly, respectively because of being undistinguished this order and the grainy levels are improved.

A toner preferably includes a polyester resin as a binder resin because of being likely to have an additive burial rate not less than 40%, improving grainy levels of the resultant images even when the first transfer pressure is low and having good fixability at low temperature and low humidity.

The image forming apparatus 100 satisfies all of these conditions.

FIG. 6 is a schematic elevational view illustrating another embodiment of the image forming apparatus of the present invention.

Points different from those of the first embodiment in this embodiment will be mainly explained, and the other points have the same numerals as those of the first embodiment and explanations thereof are omitted.

In an image forming apparatus 100, a transfer belt unit 10 is located above in the vertical direction of image forming stations 60Y, 60M, 60C and 60BK. Pressers 18Y, 18M, 18C and 18BK contact first transfer rollers 12Y, 12M, 12C and 12BK to an intermediate transfer belt 11 downward in the vertical direction to press the intermediate transfer belt 11 to photoreceptor drums 20Y, 20M, 20C and 20BK.

The pressers 18Y, 18M, 18C and 18BK specifically include the first transfer rollers 12Y, 12M, 12C and 12BK and a holder (not shown) displaceably holding the first transfer rollers 12Y, 12M, 12C and 12BK in the vertical direction. The pressers 18Y, 18M, 18C and 18BK do not have biasing means biasing the first transfer rollers 12Y, 12M, 12C and 12BK toward the intermediate transfer belt 11 such as the press spring 19Y in the first embodiment, and the first transfer rollers 12Y, 12M, 12C and 12BK contact the intermediate transfer belt 11 under their own weights. Therefore, the pressers 18Y, 18M, 18C and 18BK press the intermediate transfer belt 11 to the photoreceptor drums 20Y, 20M, 20C and 20BK downward in the vertical direction under own weights of the first transfer rollers 12Y, 12M, 12C and 12BK.

The first transfer rollers 12Y, 12M, 12C and 12BK have metallic cored bars and elastic layers covering the outer circumferential surfaces of the metallic cored bars, and have an ASKER C hardness not greater than 50 with the elastic layers.

The first transfer pressures are fixed and adjusted with weights of the metallic cored bars.

In the image forming apparatus 100 of the second embodiment, the reason why the pressers 18Y, 18M, 18C and 18BK press the intermediate transfer belt 11 to the photoreceptor drums 20Y, 20M, 20C and 20BK downward in the vertical direction with the first transfer rollers 12Y, 12M, 12C and 12BK is that a tolerance of a biasing force of the biasing means biasing the first transfer rollers 12Y, 12M, 12C and 12BK toward the intermediate transfer belt 11 such as the press spring 19Y in the first embodiment may cause uneven image density in the main scanning direction and grainy images on one side therein when black images are produced.

When the first transfer rollers 12Y, 12M, 12C and 12BK are located vertically below the photoreceptor drums 20Y, 20M, 20C and 20BK, respectively, the first transfer rollers 12Y, 12M, 12C and 12BK are pressed to the photoreceptor drums 20Y, 20M, 20C and 20BK against their own weights and the biasing force of the biasing means biasing the first transfer rollers 12Y, 12M, 12C and 12BK toward the intermediate transfer belt 11 such as the press spring 19Y needs strengthening. When the biasing force is strengthened, tolerances thereof are likely to lose the pressure balances in the scanning direction, causing the uneven image density and grainy images.

Specifically, as Example 1, when the first transfer pressure of the black toner image is 70 g/cm$^2$, the first transfer pressure of either of ends in the scanning direction is larger than 70 g/cm$^2$ and the grainy levels cannot be improved. As Example 2, when the first transfer pressure of the black toner image is 50 g/cm$^2$, the first transfer pressure of either of ends in the scanning direction is smaller than 50 g/cm$^2$, resulting in deterioration of transfer efficiency and defective transfer.

When the first transfer rollers 12Y, 12M, 12C and 12BK are located vertically above the photoreceptor drums 20Y, 20M, 20C and 20BK, the first transfer rollers 12Y, 12M, 12C and 12BK need not be pressed to the photoreceptor drums 20Y, 20M, 20C and 20BK against their own weights, the first transfer pressure balance improves in the scanning direction and the uneven image density and grainy images are prevented more than in the first embodiment.

In this embodiment, the first transfer pressures are own weights of the first transfer rollers 12Y, 12M, 12C and 12BK only, and a member such as the press spring 19Y may be used for applying the first transfer pressure. Since the member need not have a biasing force against the weights of the first transfer rollers 12Y, 12M, 12C and 12BK and the biasing force can only be supplementary. Therefore, the first transfer pressure balance in the scanning direction is good. However, in terms of simple structure, downsizing and low cost, the first transfer pressures are preferably generated only by own weights of the first transfer rollers 12Y, 12M, 12C and 12BK.

In addition, including elastic layers having an ASKER C hardness of 50 or less hardness, the first transfer rollers 12Y, 12M, 12C and 12BK are likely to dent and have larger areas contacting the intermediate transfer belt 11. Therefore, even when a balance of the first transfer pressure lowers in the axial directions of the first transfer rollers 12Y, 12M, 12C and 12BK due a tolerance of formation and composition thereof or the first transfer pressures are out of desired pressures, deterioration of the second transfer performance is prevented or controlled to produce quality images. Therefore, the first transfer pressure can be lowered.

The image forming apparatus 100 of the second embodiment is different from the image forming apparatus 100 of the first embodiment at a point where it is a complex machine of a printer and a facsimile, a point where the second transferer is included in a transfer and transport unit 17 also transporting a sheet to the fixer 6, and a point where a both side printing unit is omitted.

Having now fully described the invention, it will be apparent to one of ordinary skill in the art that many changes and modifications can be made thereto without departing from the spirit and scope of the invention as set forth therein.

For example, each color toner image may directly be transferred onto a sheet without using an intermediate transferer. In this case, toner images on plural image bearers are directly transferred onto the sheet.

The intermediate transferer may have the shape of a drum, not limited to a belt.

The image forming apparatus may be a stand-alone copier, a printer or a facsimile, not limited to a complex machine thereof, and may have other combinations such as a combination of a copier and a printer.

This application claims priority and contains subject matter related to Japanese Patent Applications Nos. 2007-181466 and 2008-026587, filed on Jul. 10, 2007, and Feb. 6, 2008, respectively, the entire contents of each of which are hereby incorporated by reference.

What is claimed as new and desired to be secured by letters patent of the United States is:

1. An image forming apparatus, comprising:

plural image bearers configured to bear toner images comprising a black toner image, which are developed with a two-component developer comprising a carrier and a toner including a binder resin and an additive;

a receptor configured to receive the toner images;

plural pressers each configured to press the receptor to each of the plural image bearers at a predetermined pressure, wherein the additive has a burial rate X indicated by the following formula not less than 40%:

$$X=(A-B)/A\times 100$$

wherein A represents a BET specific surface area (cm2/g) of the toner and B represents a BET specific surface area (cm2/g) of the toner after the additive is buried, wherein one of the pressers pressing the receptor to the image bearer bearing the black toner image presses the receptor thereto at a pressure lower than those of the other pressers, wherein each of the pressers includes a pressing member contacting the receptor, configured to press the receptor to each of the image bearers downward in the vertical direction, wherein the predetermined pressure of each presser is generated by a weight of each presser, and wherein the weight of the plural pressers is different between two or more pressers.

2. The image forming apparatus of claim 1, wherein each of the pressing members press the receptor to each of the image bearers under its own weight.

3. The image forming apparatus of claim 1, wherein each of the pressers has an ASKER C hardness not greater than 50.

4. The image forming apparatus of claim 1, wherein the receptor is an intermediate transferer, and further comprising:

plural first transferers each configured to transfer the toner image on each of the image bearers onto the intermediate transferer; and a second transferer configured to transfer the toner image on the intermediate transferer onto a sheet.

5. The image forming apparatus of claim 4, wherein one of the first transferers transfers a black toner image last.

6. The image forming apparatus of claim 4, wherein one of the first transferers transfers a yellow toner image first.

7. The image forming apparatus of claim 4, wherein two of the first transferers transfer a magenta toner image secondly and a cyan toner image thirdly, respectively.

8. The image forming apparatus of claim 1, wherein the binder resin is a polyester resin.

9. An image forming method, comprising:

forming an image with the image forming apparatus according to claim 1.

10. The image forming apparatus of claim 1, wherein each of the pressers includes a core section such that the predetermined pressure of each presser is configurable by selecting a weight of the core section.

11. An image forming apparatus, comprising:

plural image bearers configured to bear toner images comprising a black toner image, which are developed with a two-component developer comprising a carrier and a toner including a binder resin and an additive;

a receptor configured to receive the toner images;

plural pressers each configured to press the receptor to each of the plural image bearers at a predetermined pressure, wherein the predetermined pressure of each presser varies between two or more pressers because of a weight difference between the two or more pressers, wherein the predetermined pressure is set by a weight of the presser, wherein the additive has a burial rate X indicated by the following formula not less than 40%:

$$X=(A-B)/A\times 100, \text{ and}$$

wherein A represents a BET specific surface area (cm2/g) of the toner and B represents a BET specific surface area (cm2/g) of the toner after the additive is buried.

12. The image forming apparatus of claim 3, wherein each presser is likely to deform and contact the receptor with an increased surface area.

13. An image forming apparatus, comprising:

plural image bearers configured to bear toner images comprising a black toner image, which are developed with a two-component developer comprising a carrier and a toner including a binder resin and an additive;

a receptor configured to receive the toner images;

plural pressers each configured to press the receptor to each of the plural image bearers at a predetermined pressure;

a drive unit configured to set the plural image bearers except one of the plural image bearers bearing the black toner image apart from the receptor, keeping the image bearer bearing the black toner image contacting the receptor, wherein the additive has a burial rate X indicated by the following formula not less than 40%:

$$X=(A-B)/A\times 100, \text{ and}$$

wherein A represents a BET specific surface area (cm2/g) of the toner and B represents a BET specific surface area (cm2/g) of the toner after the additive is buried, and wherein one of the pressers pressing the receptor to the image bearer bearing the black toner image presses the receptor thereto at a pressure lower than those of the other pressers.

14. An image forming apparatus, comprising:

plural image bearers configured to bear toner images comprising a black toner image, which are developed with a two-component developer comprising a carrier and a toner comprising a binder resin and an additive;

a receptor configured to receive the toner images;

plural pressers each configured to press the receptor to each of the plural image bearers at a predetermined pressure, wherein the additive has a burial rate X indicated by the following formula not less than 40%:

$$X=(A-B)/A\times 100, \text{ and}$$

wherein A represents a BET specific surface area ($cm^2/g$) of the toner; and B represents a BET specific surface area ($cm^2/g$) of the toner after the additive is buried, and wherein one of the pressers pressing the receptor to the image bearer bearing the black toner image presses the receptor thereto at a pressure lower than those of the other pressers.

15. The image forming apparatus of claim 14, wherein each of the pressers has an ASKER C hardness not greater than 50.

16. The image forming apparatus of claim 14, wherein the binder resin is a polyester resin.

17. The image forming apparatus of claim 14, wherein the receptor is an intermediate transferer, and further comprising:

plural first transferers each configured to transfer the toner image on each of the image bearers onto the intermediate transferer; and a second transferer configured to transfer the toner image on the intermediate transferer onto a sheet.

18. The image forming apparatus of claim 17, wherein one of the first transferers transfers a black toner image last.

19. The image forming apparatus of claim 17, wherein one of the first transferers transfers a yellow toner image first.

20. The image forming apparatus of claim 17, wherein two of the first transferers transfer a magenta toner image secondly and a cyan toner image thirdly, respectively.

* * * * *